US006436014B1

(12) United States Patent
Cirjak

(10) Patent No.: US 6,436,014 B1
(45) Date of Patent: Aug. 20, 2002

(54) UNIVERSAL RESISTANCE CROSS-TRAINING SYSTEM

(75) Inventor: David Cirjak, Burnaby (CA)

(73) Assignee: The Hygenic Corporation, Akron, OH (US)

( * ) Notice: Subject to any disclaimer, the term of this patent is extended or adjusted under 35 U.S.C. 154(b) by 0 days.

(21) Appl. No.: 09/230,384

(22) PCT Filed: Aug. 14, 1997

(86) PCT No.: PCT/CA97/00565

§ 371 (c)(1),
(2), (4) Date: Jan. 22, 1999

(87) PCT Pub. No.: WO98/06459

PCT Pub. Date: Feb. 19, 1998

(30) Foreign Application Priority Data

Aug. 16, 1996 (CA) ..... 2183484

(51) Int. Cl.[7] ..... A63B 21/065

(52) U.S. Cl. ..... 482/105; 482/93; 446/26

(58) Field of Search ..... 482/93, 105, 46, 482/111, 110, 131, 92, 148, 908; 441/55, 56, 57, 58, 59, 60–64, 129, 131, 136; 446/26, 28, 127

(56) References Cited

U.S. PATENT DOCUMENTS 1,909,259 A * 5/1933 Feir ..... 441/60
3,427,022 A 2/1969 Ward ..... 272/80
4,684,122 A * 8/1987 Desmond et al. ..... 272/119
4,721,300 A * 1/1988 Guzman ..... 272/116
4,949,957 A * 8/1990 Cucchiara ..... 272/119
5,217,186 A * 6/1993 Stewart et al. ..... 244/142
5,700,173 A * 12/1997 Lerro ..... 441/57
5,957,515 A * 9/1999 Van Der Sluys ..... 294/25

FOREIGN PATENT DOCUMENTS

| | | |
|---|---|---|
| BE | 643047 | 5/1964 |
| DE | 552661 | 3/1932 |

* cited by examiner

*Primary Examiner*—Justine R. Yu
*Assistant Examiner*—Tam Nguyen
(74) *Attorney, Agent, or Firm*—Jones, Day, Reavis & Pogue

(57) ABSTRACT

A universal resistance cross-training system is described which is adapted to direct a variety of resistance forces to robust portions of an exerciser's limb, while leaving hands and feet free for normal use. The system is based upon an arched cuff which provides both transverse compression sockets at either end and ratcheted channels following the outside surface of the cuff and extending between the two compression mounts. Resistance devices such as fins, elastics, weights, parachutes, floats and linkages are connected to the cuff via either the compression sockets or the ratcheted channel. The resistance forces are transferred from the resistance devices through the arch to the user's limbs.

4 Claims, 9 Drawing Sheets

UNIVERSAL RESISTANCE CROSS-TRAINING SYSTEM

BACKGROUND

This invention relates to exercise devices. More specifically, it relates to devices that resist the movement of an exerciser's limbs in order to encourage a more intense workout.

A key goal of exercise is to develop the body's ability to work harder. To this end, many exercise programs incorporate means for variably resisting the body's movement. For example, on a stationary bicycle, the exerciser can vary the pedal resistance. He can either increase resistance over a period of months to keep challenging his improving body or he can increase resistance just on hectic days to get his usual workout in a shorter time.

A whole industry has developed to harness the advantages inherent in specific types of resistances such as fluid resistance, elastic resistance, and gravitational resistance. Unfortunately, exercise equipment tends to be expensive, bulky and specialized; an exerciser is faced with the prospect of securing a room fill of equipment just to get a balanced workout. Although each form of resistance has advantages, many exercisers tend to use whatever machines are available and may eventually become partial to one form of resistance. Some people only use free weights. Others swear by hydrodynamic resistance. Still others prefer springs. In contrast, it would be desirable to have available a versatile and portable resistance device that could apply various forms of resistance while a user is running, swimming, cycling, skiing and the like.

The need for portability has been recognized for some time. For example, U.S. Pat. No. 4,997,183 granted to Edith Winston on Mar. 5, 1991 for an, "Ankle Weigh Exercise Device," discloses the use of a removable ankle band with a set of pockets for holding weights. While the Winston invention provides resistance, such resistance is limited to a fixed gravitational pull directly downward on the contained weights. If the exerciser wants a more complicated resistance or combination of resistances, the Winston device will not assist him.

U.S. Pat. No. 4,923,418 granted to Ned Hoffman on May 8, 1990 for an, "Exercise Glove," discloses the use of a glove with webbing between the fingers and a set of pockets for holding weights. The exerciser can thereby combine gravitational and fluid resistance in his exercise. Unfortunately, the Hoffman device has a number of disadvantages. The fluid resistance mechanism only works when the webbing is extended by holding the hands and fingers in a position that is unnatural, uncomfortable, and unproductive. The hands are not free to perform other task while extending the webbing. Also, other forms of resistance are not supported by the device.

What is needed is a portable device that resists limb movement by ergonomically transferring a variety of resistive forces to the limb.

SUMMARY

The present invention is directed to such a device.

According to one aspect of the invention there is provided a cuff for transferring a force to a portion of a user's body, the cuff comprising: an elongated arch having a first leg and a second leg and being adapted to cup the portion of the user's body, a retention strap adapted to engage the first leg of the arch and the second leg of the arch and thereby form an enclosed region for circumscribing the portion of the user's body, and means for applying a force to the arch whereby the arch and the retention strap transfer the applied force to the portion of the use's body. The cuff might be stiff and might be resilient.

The retention strap might resist movement of the first leg of the arch in a direction away from the second leg of the arch or might even draw together the first leg of the arch and the second leg of the arch, thereby springing the arch.

The arch might include a compression socket passing longitudinally through the elongated arch and adapted to receive force from the force applying means. The arch might include a channel extending longitudinally along the first leg of the arch and adapted to receive force from the force applying means. The channel might be ratcheted.

For comfort, the cuff might further include an inner sleeve inscribing the region defined by the arch and the retention strap. Similarly, the arch, the retention strap and the inner sleeve might be perforated to facilitate passage of air or water.

The force applying means might be a fin, a weight, a spring, a parachute, a float, a second cuff, a pull buoy or the like.

According to another aspect of the invention, there is provided a kit of parts for transferring a force to a portion of a user's body, the kit comprising: a cuff adapted to circumscribe the portion of the user's body, a first resistance device, a second resistance device, means for securing the first resistance device to the cuff, and means for securing the second resistance device to the cuff.

The first resistance device might be a weight and the second resistance device might be a fin, a spring, a parachute, a float, a second cuff or the like.

The cuff might comprise: an elongated arch having a first leg and a second leg and being adapted to cup the portion of the user's body and a retention strap adapted to engage the first leg of the arch and the second leg of the arch and thereby form an enclosed region for circumscribing the portion of the user's body. The arch might be stiff or resilient The retention strap might resist movement of the first leg of the arch in a direction away from the second leg of the arch or it might even draw together the first leg of the arch and the second leg of the arch, thereby springing the arch.

According to yet another aspect of the invention, there is provided a method of transferring a force to a portion of a user's body, the method comprising: providing an elongated arch having a first leg and a second leg and being adapted to cup the portion of the user's body, providing a retention strap adapted to engage the first leg of the arch and the second leg of the arch and thereby form an enclosed region for circumscribing the portion of the user's body, cupping the portion of the user's body within the arch, engaging the first leg of the arch and the second leg of the arch with the retention strap so as to circumscribe the portion of the user's body, and providing means for applying a force to the arch whereby the arch and the retention strap transfer the applied force to the portion of the use's body.

The arch might be stiff or resilient. The retention strap might resist movement of the first leg of the arch in a direction away from the second leg of the arch or it might even draw together the first leg of the arch and the second leg of the arch, thereby springing the arch.

The arch might include a compression socket passing longitudinally through the elongated arch and adapted to receive force from the force applying means. The arch might include a channel extending longitudinally along the first leg of the arch and adapted to receive force from the force applying means. The channel might be ratcheted.

To improve comfort, the method might further include providing an inner sleeve to inscribe the region defined by the arch and the retention strap.

BRIEF DESCRIPTION OF THE DRAWINGS

These and other features, aspects, and advantages of the present invention will become better understood with reference to the following description, appended claims, and accompanying drawings where:

DESCRIPTION

Figure 1:
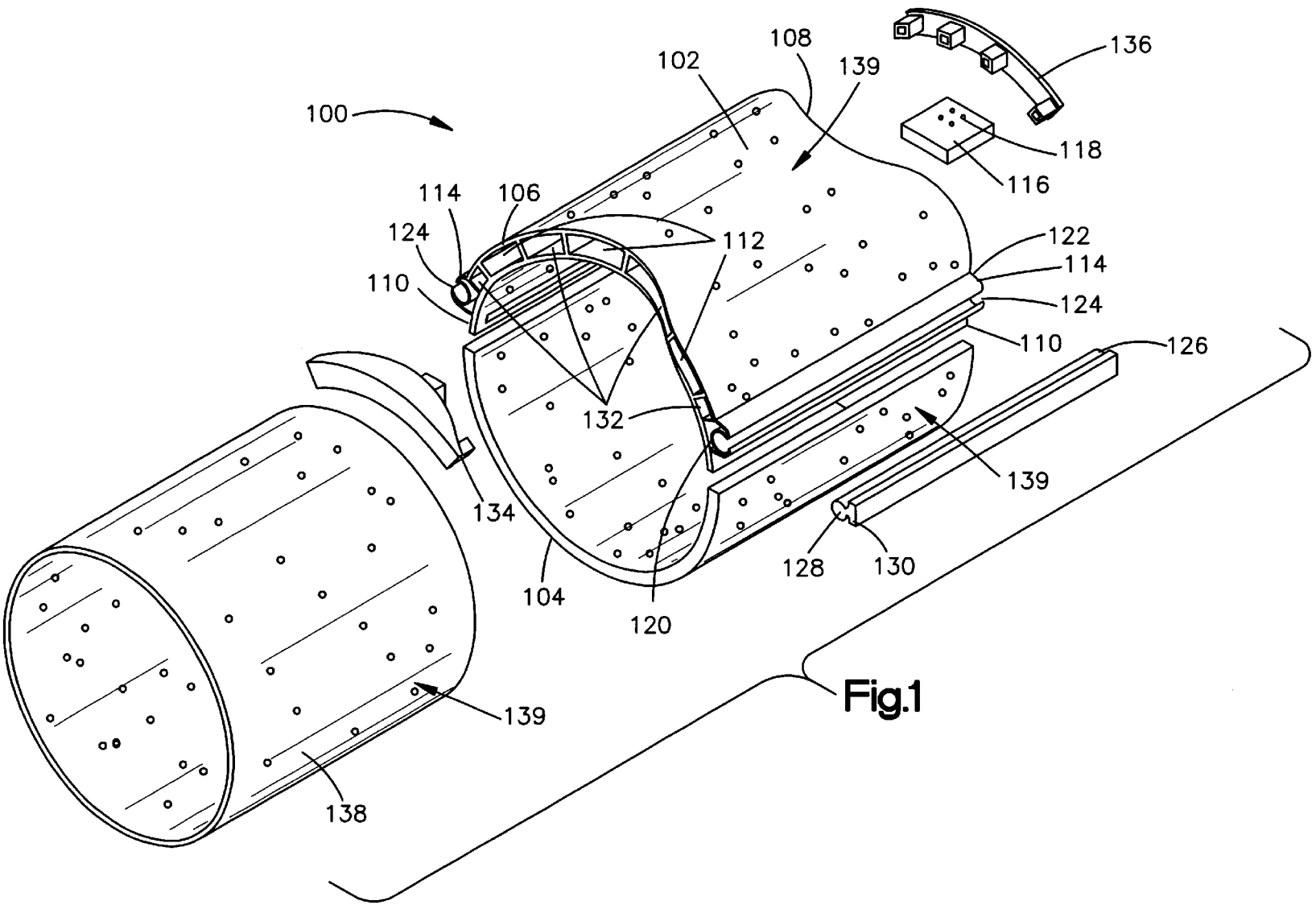
FIG. 1 is an isometric view of a universal resistance cuff embodying a first aspect of the invention.

With reference now to FIG. 1, a universal resistance cuff embodying one aspect of the invention is generally illustrated at 100. The cuff 100 includes an elongated arch 102 and a retention strap 104. The arch 102 has a first end 106, a second end 108 and two legs 110 tat are spaced apart and opposite and that extend the length of the arch 102 from its first end 106 to its second end 108. It should be noted that each of the arch's 102 ends 106, 108 is scalloped. The arch's 102 size and shape are selected to loosely cradle a part of the user's body such as his forearm, calf, hand, foot, waist, chest, or even head. The retention strap 104 is adapted to engage the two legs 110 of the arch 102 and to draw them together so as to spring the arch 102 and form the cuff 100. The arch 102 is preferably made from a stiff but resilient material such that it has an arch's tendency to solidly resist inward forces and a spring's tendency to elastically resist outward forces, whereby the arch 102 tries to maintain its shape even under or subsequent to stress.

The arch 102 includes two types of means for securing a resistance device 111 to the cuff 100. Three compression sockets 112 pass longitudinally through the elongated arch 102 between its first end 106 and its second end 108. Each of the arch's 102 two legs 110 supports a longitudinal ratcheted channel 114 extending between the first end 106 and the second end 108.

Each compression socket 112 is adapted to releasably retain a co-operating compression peg 116. The compression peg 116 may include any of the well know characteristics for expanding an outside circumference. Such characteristics include surface blisters 118, knurling (not shown), and gaskets (not shown). Such expansion characteristics could be similarly applied to the inside surface of the compression sockets 112.

Each ratcheted channel 114 has two open ends 120, 122 and defines a polygonal internal perimeter having a single breach 124 which extends between the two open ends 120, 122. The ratcheted channel 114 is adapted to accept a pawl 126 through either end 120, 122 and to releasably retain a first portion 128 of the pawl 126 within the channel 114 while exposing a second portion 130 of the pawl 126 through the breach 124. The pawl 126 and the ratcheted channel 114 are adapted to co-operatively engage each other at a plurality of discrete angles about their coaxial longitudinal axes.

Four endcap connection sockets 132 also pass longitudinally through the elongated arch 102 between its first end 106 and its second end 108. First and second endcaps 134, 136 are adapted to seal the arch's 102 ends 106, 108 by co-operatively engaging the endcap connection sockets 132. The ratcheted channel's 114 ends 120, 122 are closed off by the endcaps 134, 136 when they are in place.

An inner sleeve 138 inscribes the cuff 100, and is preferably made of a soft rubber-like material such as neoprene. The surface of the arch 102, the retention strap. 104 and the inner sleeve 138 may define perforations generally illustrated at 139 sized to allow air or water to pass through.

With reference now to FIGS. 2 through 9, the cuff 100 is illustrated retaining a variety of resistance devices 111*a*, 111*b*, 111*c*, 111*d*, 111*e*, 111*f*, 111*g*, 111*h*. Each resistance device 111 will be discussed in greater detail below.

Figure 2:
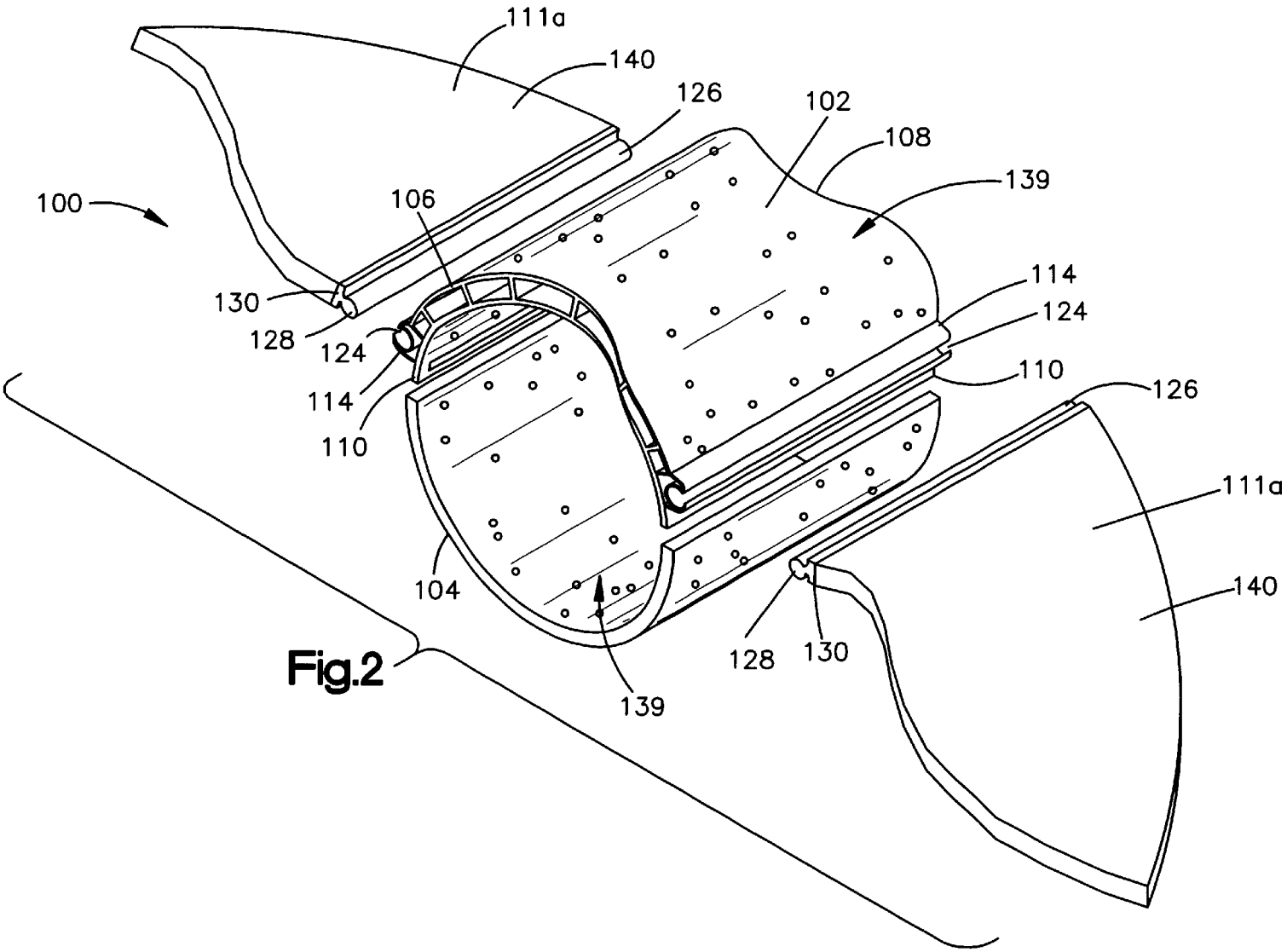
FIG. 2 is an exploded isometric view of the cuff of FIG. 1 engaging a pair of radial fins with the ratcheted channels.

With reference now to FIG. 2, the universal resistance cuff 100 is illustrated as adapted to receive and retain a fluid resistance device 111*a* in the form of two radial fins 140. Each fin 140 extends from an elongated pawl 126 which defines one edge of the fin 140. The pawl 126 is adapted to be received and retained within the ratcheted channel 114. The pawl 126 and the channel 114 cooperate to engage each other at a plurality of discrete angles about their coaxial longitudinal axes such that the fin 140 is enabled to adopt either a perpendicular or an oblique stance with respect to the cuff 100 at the point of their incidence.

Figure 3:
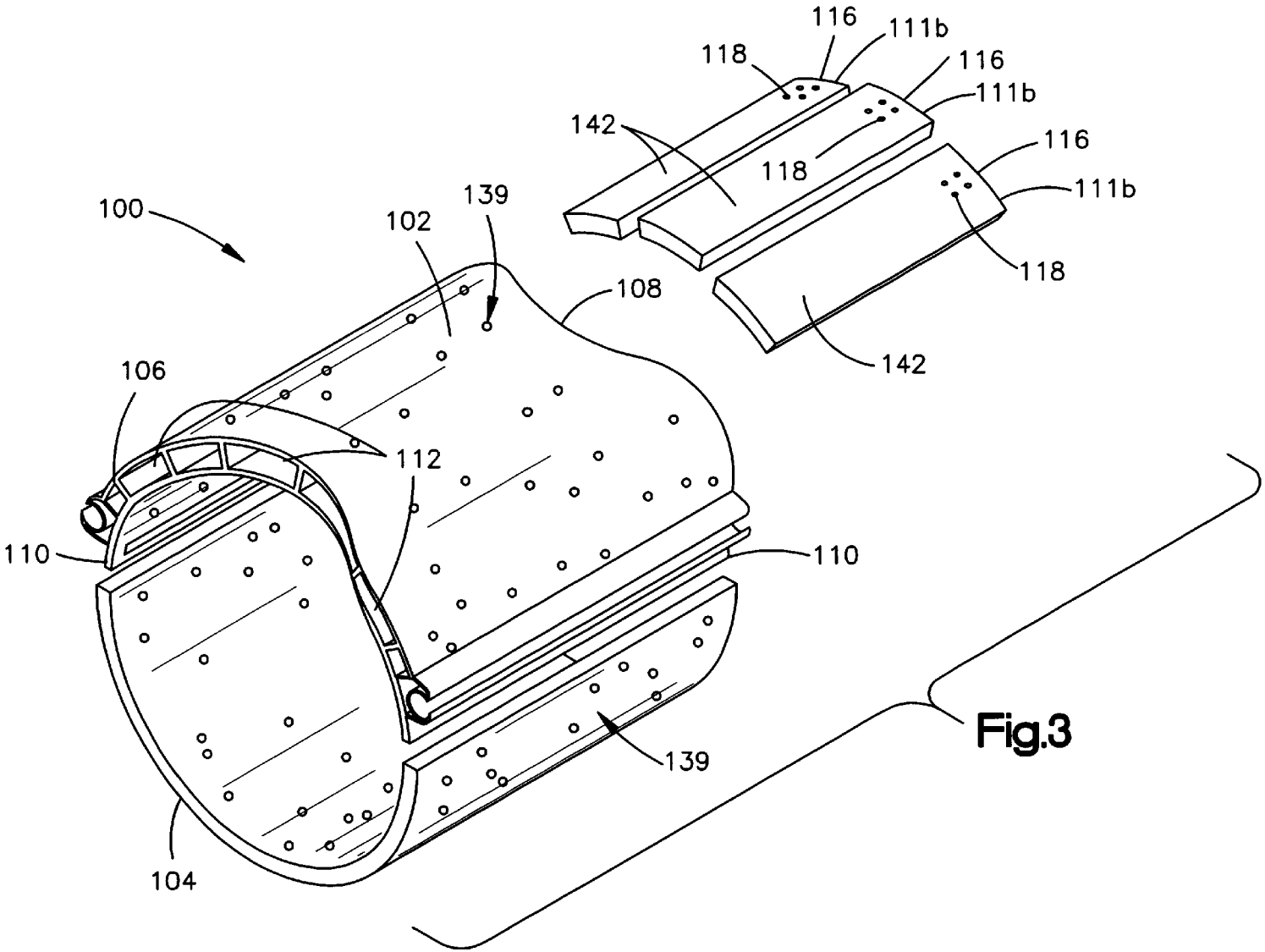
FIG. 3 is an exploded isometric view of the cuff of FIG. 1 engaging a plurality of weights with the compression sockets.

With reference now to FIG. 3, the universal resistance cuff 100 is illustrated as adapted to receive and retain a gravitational resistance device 111*b* in the form of a plurality of compression pegs 116 bearing weights 142. The compression pegs 116 fit snugly but releasably within the compression sockets 112, thereby increasing the mass of the cuff 100.

Figure 4:
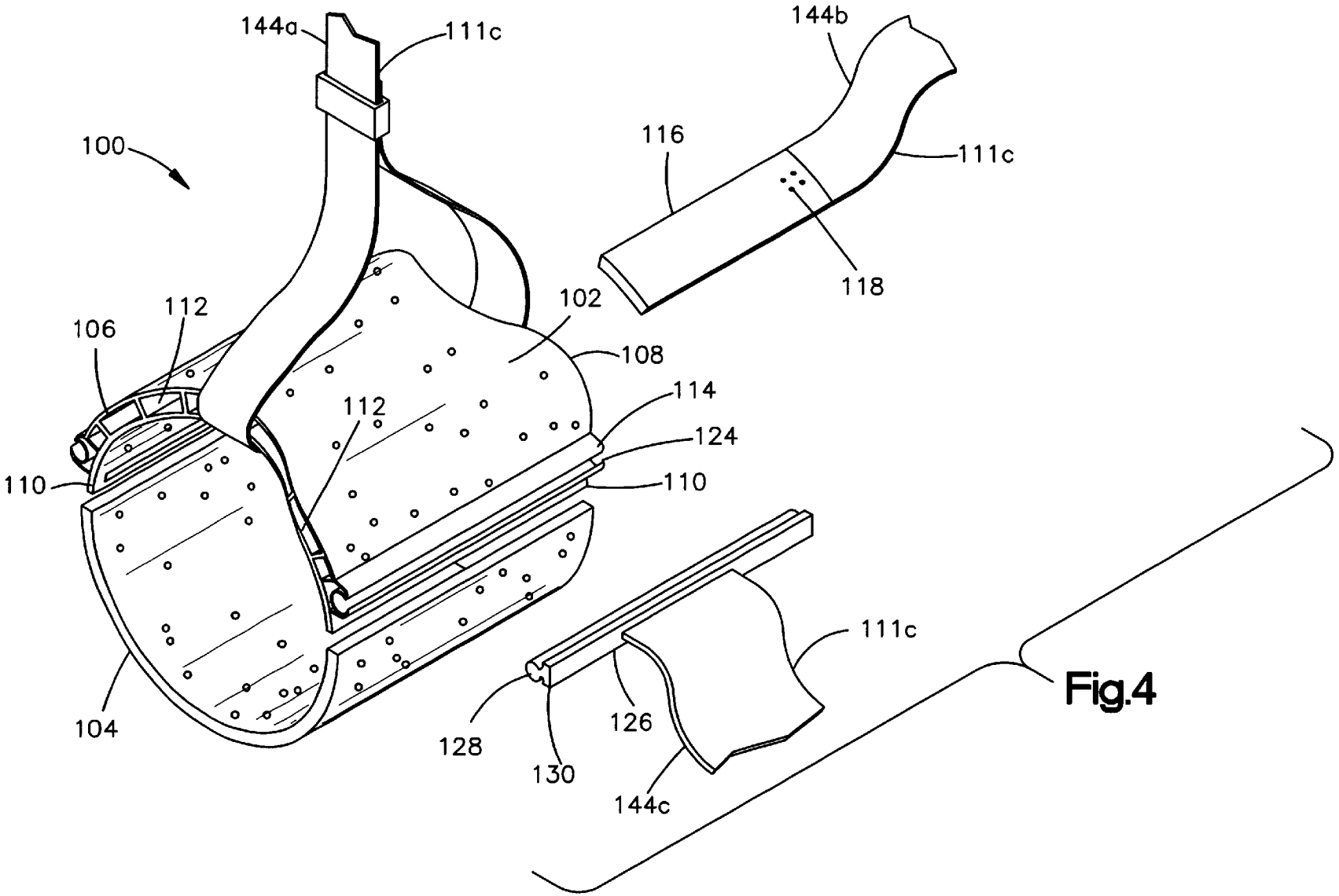
FIG. 4 is an exploded isometric view of the cuff of FIG. 1 engaging elastic tubing with the ratcheted channels and the compression sockets.

With reference now to FIG. 4, the universal resistance cuff 100 is illustrated as adapted to receive and retain an elastic resistance device 111*c* in the form of a ribbon of elastic material 144*a*, 144*b*, 144*c*. The ribbon 144*a* may be simply tied to a compression socket 112. Alternatively, the ribbon 144*b* may be terminated in a compression peg 116.for engaging a compression socket 112 or the ribbon 144*c* may be terminated in a pawl 126 for insertion and retention in a ratcheted channel 114.

Figure 5:
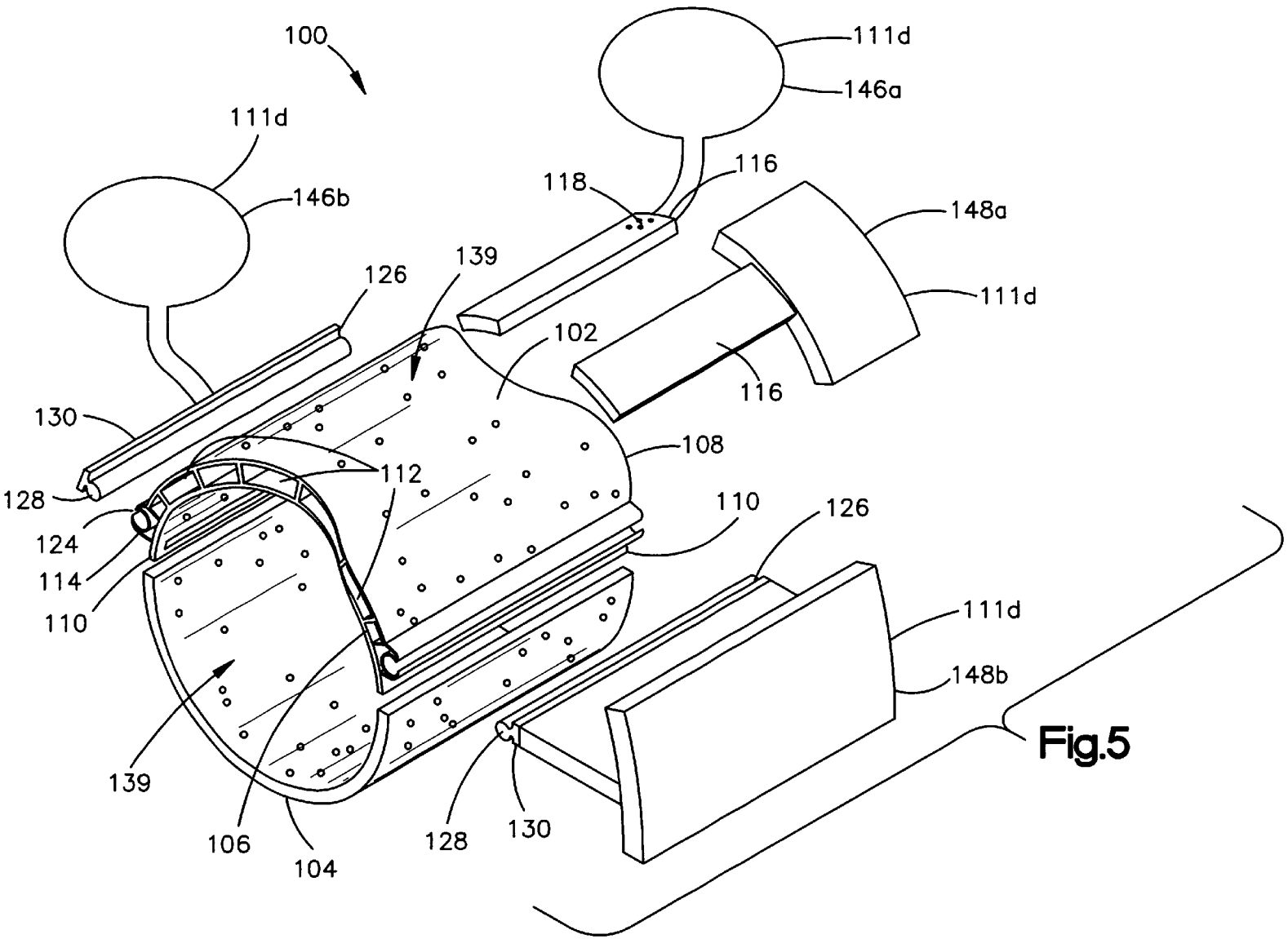
FIG. 5 is an exploded isometric view of the cuff of FIG. 1 engaging buoyant floats with the ratcheted channels and the compression sockets.

With reference now to FIG. 5, the universal resistance cuff 100 is illustrated as adapted to receive and retain a buoyancy resistance device 111*d* in the form of a float 146*a*, 146*b* or an outrigger buoyancy chamber 148*a*, 148*b*. The buoyancy device 146*a*, 148*a* may be connected to the cuff 100 via a compression peg 116 for insertion and retention into a compression socket 112 or the buoyancy device 146*b*, 148*b* may be connected to the cuff 100 via a pawl 126 for insertion and retention in a ratcheted channel 114.

Figure 6:
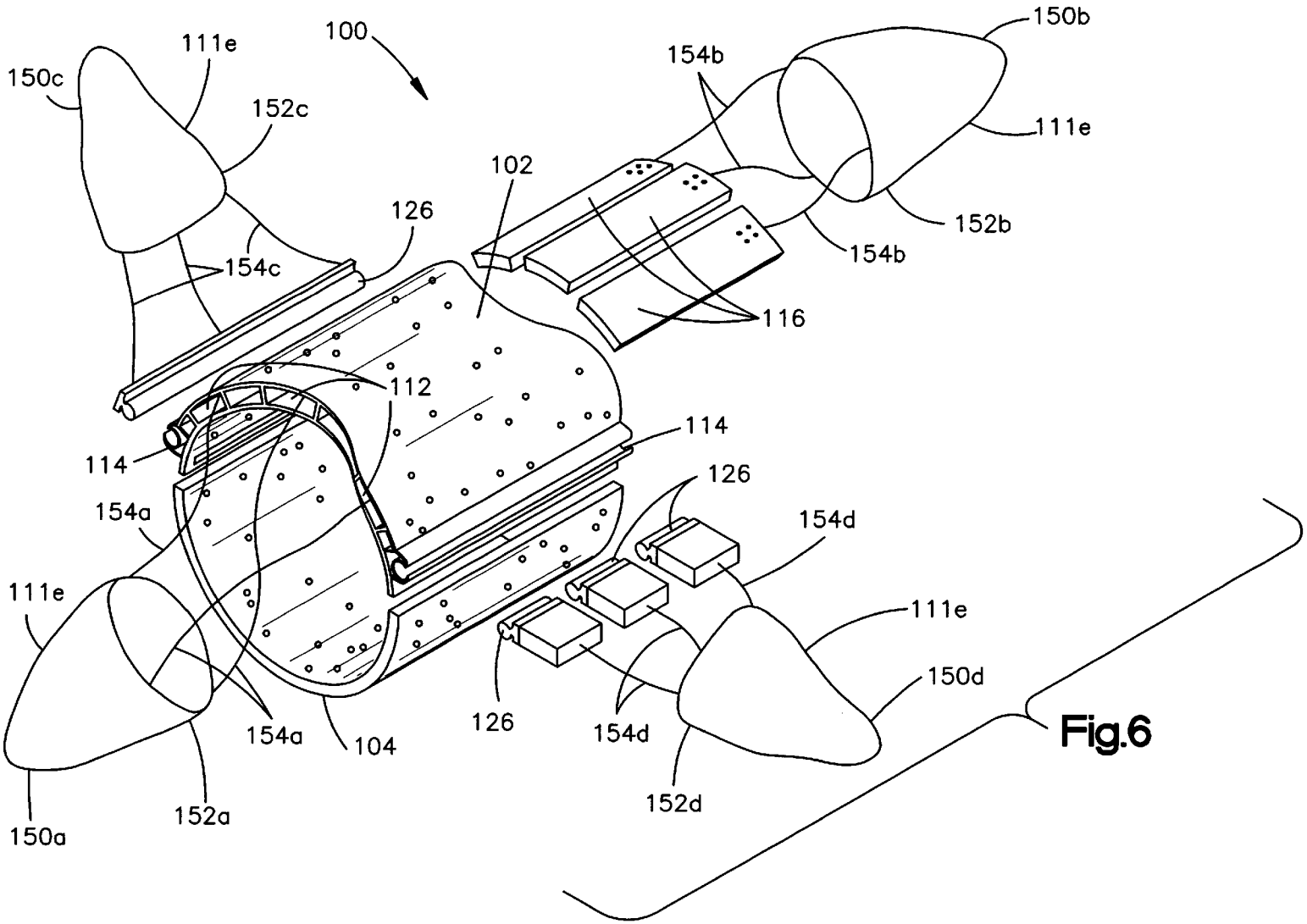
FIG. 6 is an exploded isometric view of the cuff of FIG. 1 engaging parachutes with the ratcheted channels and the compression sockets.

With reference now to FIG. 6, the universal resistance cuff 100 is illustrated as adapted to receive and retain a fluid resistance device 111*e* in the form of a parachute generally illustrated at 150*a*, 150*b*, 150*c*, 150*d*. The parachute 150*a*, 150*b*, 150*c*, 150*d* comprises a flexible sheet 152*a*, 152*b*, 152*c*, 152*d* and a plurality of strings 154*a*, 154*b*, 154*c*, 154*d* depending from the periphery of the sheet 152*a*, 152*b*, 152*c*, 152*d*. The free end of each string 154*a* can be simply tied to a compression socket 112. Alternatively, each string 154*b* may be terminated in a compression peg 116 for engaging a compression socket 112. Alternatively, the free end of each string 154*c*, 154*d* may be terminated in a single pawl 126 or a plurality of pawls 126 for insertion and retention in a ratcheted channel 114.

Figure 7:
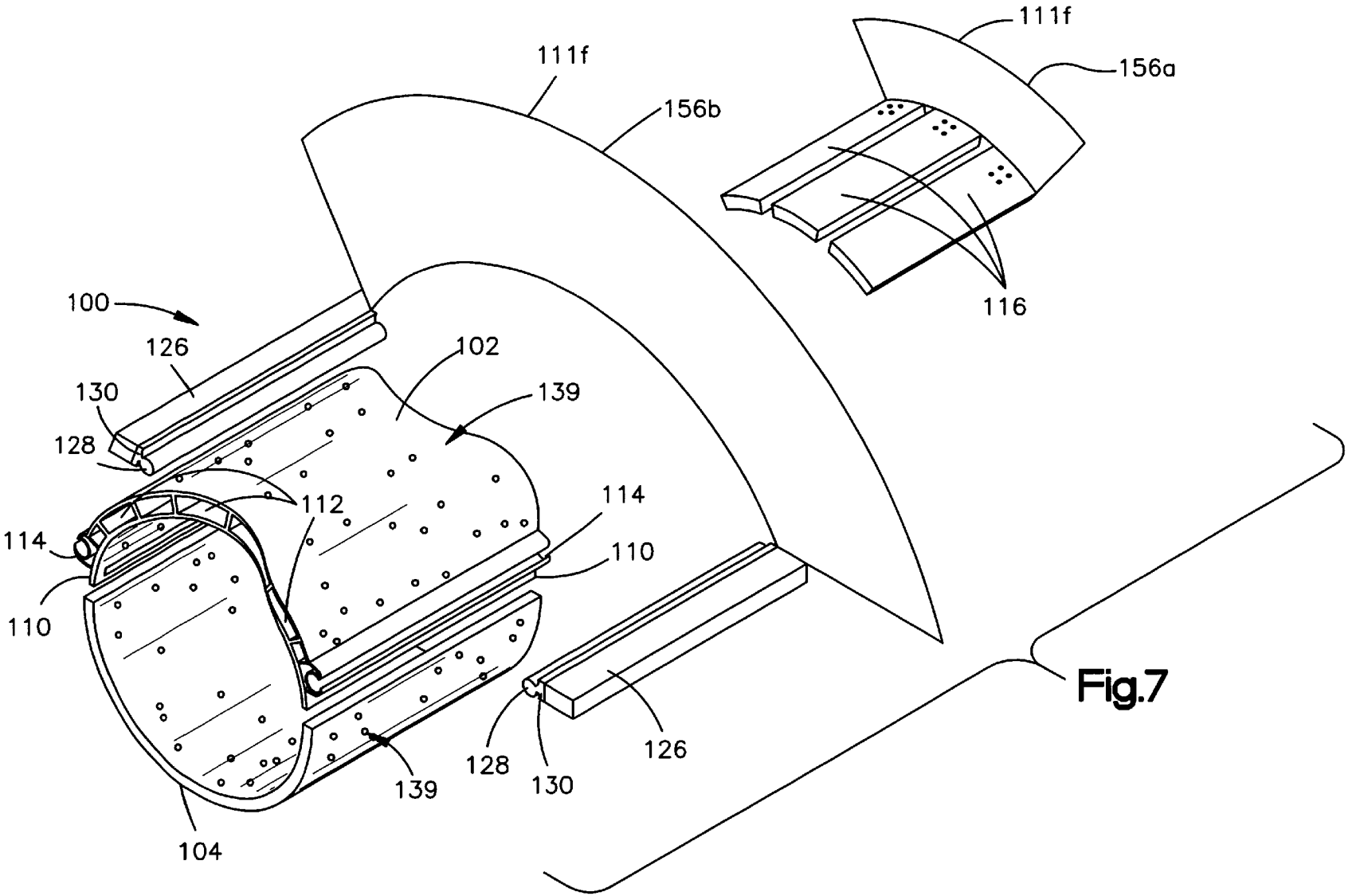
FIG. 7 is an exploded isometric view of the cuff of FIG. 1 engaging a transverse fin with the compression sockets.

With reference now to FIG. 7, the universal resistance cuff 100 is illustrated as adapted to receive and retain a fluid resistance device 111*f* in the form of a transverse fin 156*a*, 156*b*. The transverse fin 156*a* may be connected to the cuff 100 via a compression peg 116 for insertion and retention into a compression socket 112 or the transverse fin 156*b* may be connected to the cuff 100 via a pawl 126 for insertion and retention in a ratcheted channel 114.

Figure 8:
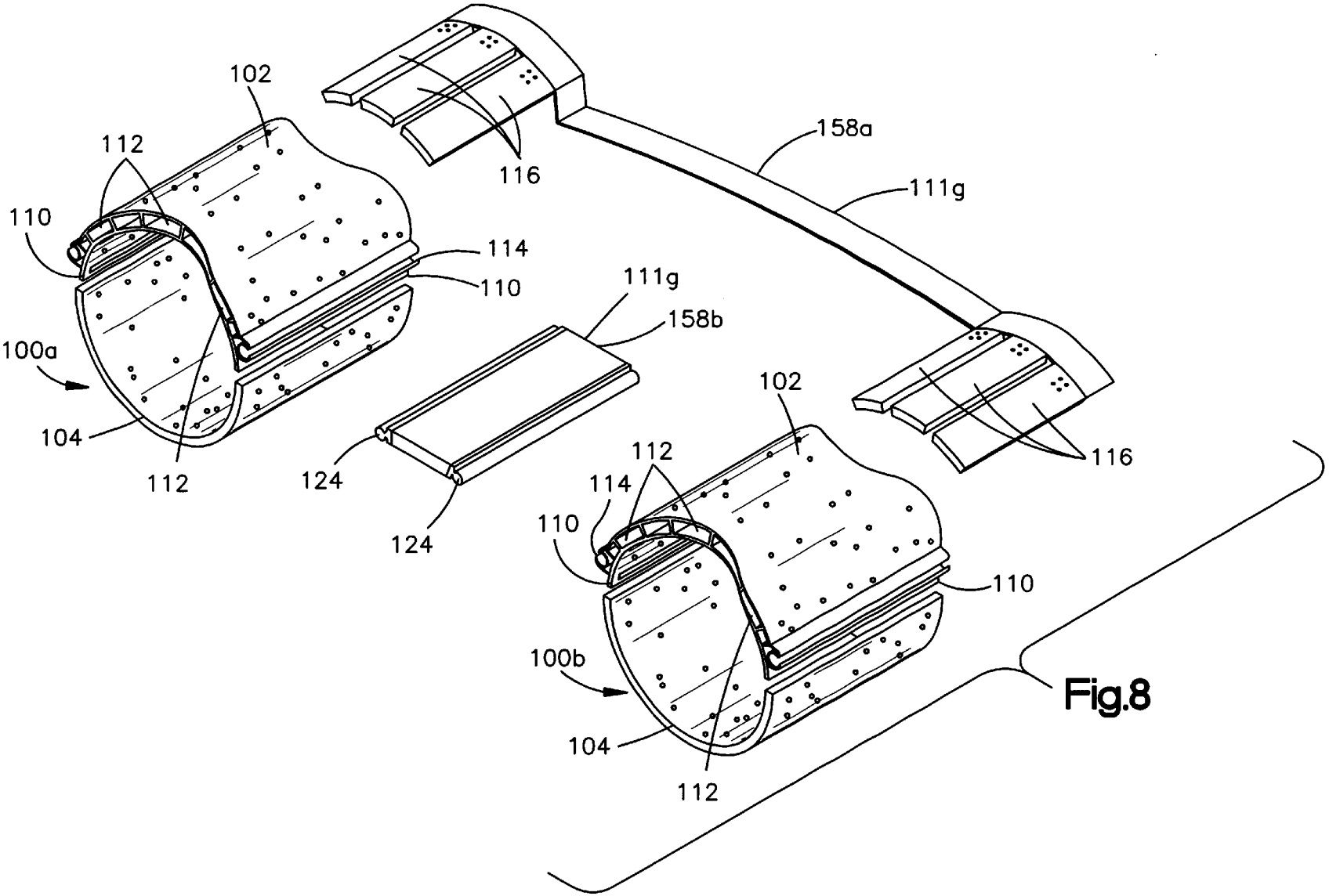
FIG. 8 is an exploded isometric view of two of the devices of FIG. 1 ganged together.

With reference now to FIG. 8, two universal resistance sleeves 100*a*, 100*b* are illustrated ganged together through a connector clip 158*a*, 158*b* whereby each sleeve 100 functions as a muscular resistance device 111*g* for the other sleeve 100. Essentially, ganging the sleeves 100 together creates a muscular resistance device 111*g* wherein a user's limbs must move in synchronization or else each will resist the other. The connector clip 158 may terminate in an plurality of compression pegs 116 for insertion and retention into the compression sockets 112. Alternatively, the connector clip 158*b* may terminate in two pawls 124 for insertion and retention into the ratcheted channel 114. The connector clip 158 may be either rigid, flexible, or elastic.

Figure 9:
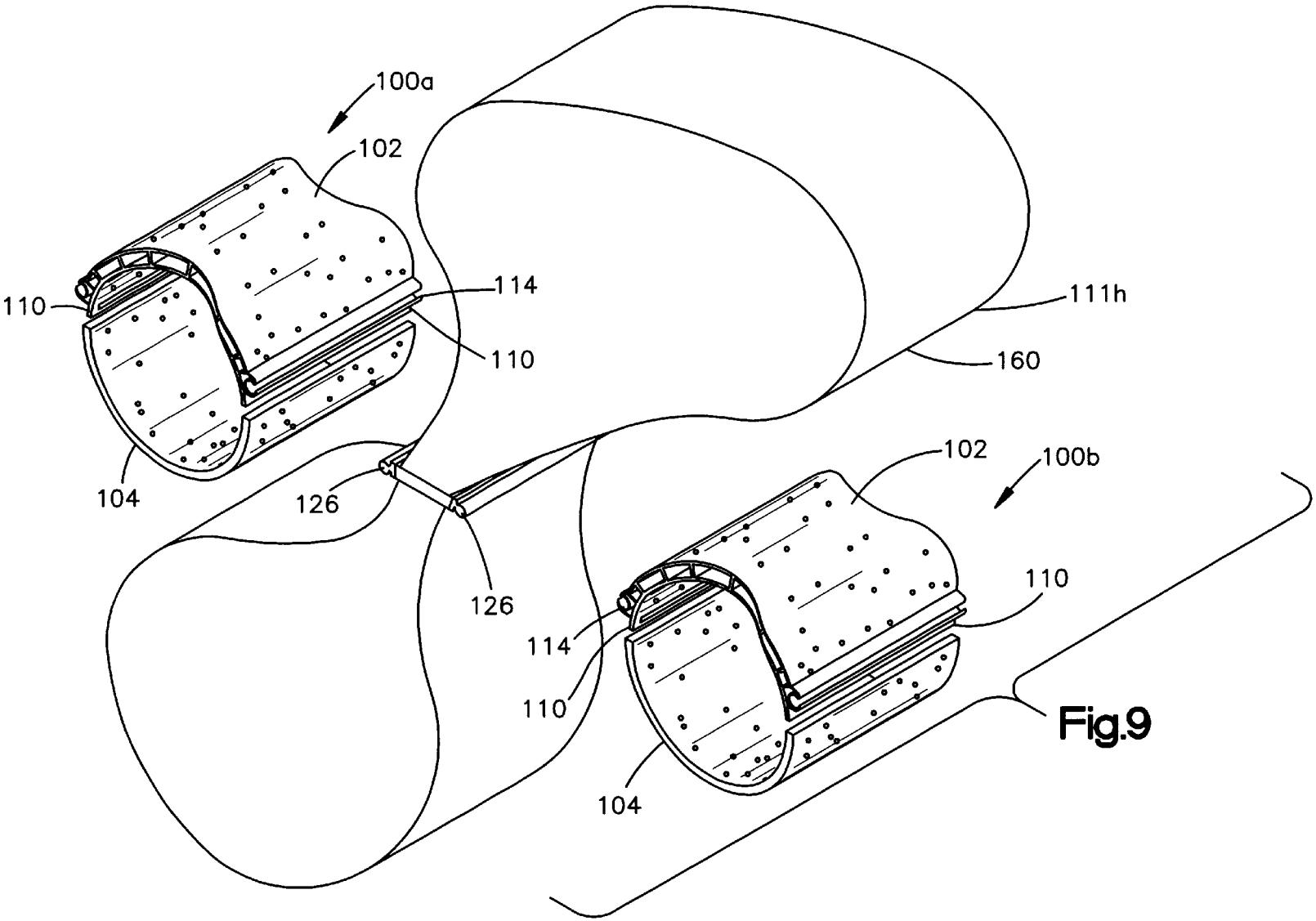
FIG. 9 is an exploded isometric view of two of the devices of FIG. 1 engaging a pull buoy with the ratcheted channels.

With reference now to FIG. 9, two universal resistance sleeves 100*a*, 100*b* are illustrated as adapted to receive and retain a buoyancy resistance device 111*h* in the form of a pull buoy 160. The pull buoy 160 may be connected to the sleeves 100*a*, 100*b* via two pawls 126 for insertion and retention in a ratcheted channel 114.

In operation, the exerciser slips a limb into the cuff 100 by cupping the arch 102 around the limb and then cinching the retention strap 104. Advantageously, the cuff 100 can be placed away from weak points such as the ankle joint or wrist joint. The scalloped profile of the ends 106, 108 discourages the ends 106, 108 from cutting or pressing into the limb and the soft inner sleeve 138 provides additional cushioning. The arch 102, sprung by the retention strap 104, has some strength and stability independent of the users limb and is therefore well suited for supporting external resistance devices 111 and for transferring and distributing resistance forces to the user's limb without pinching or buckling. Because the arch 102 is more rigid than conventional wristband style devices, the retention strap need not be cinched as tightly to the user's limb in order to provide the cuff 100 with the strength needed to support the resistance devices 111 and oppose the resistance forces. It will be noted that the perforations 139 in the arch 102, retention strap 104 and inner sleeve 138 encourage the circulation of air or water about the exercisers limb.

The exerciser configures the cuff 100 with one or more resistance devices 111 to yield the type, amount, and orientation of resistance force that he wants to fight He can combine resistance means to produce a complex resisting force with elastic, fluid, and gravitational components. His choice is guided by his exercise environment and the expected movement of his limb.

For example, a swimmer might combine weight resistance devices 111*b* and buoyancy resistance devices 111*d* on his arms. Such a combination would push his arms upward while underwater and downward while above water, thereby providing resistance through much of his stroke.

An aquaciser would perhaps combine fluid resistance devices 111*a* with elastic resistance devices 111*c* to provide resistance that varied with both the stretch distance of the elastic 144 and the speed of the fin 140.

Similarly a cyclist might combine weight resistance devices 111*b* with fluid resistance devices 111*f* on his legs. A runner might combine weight resistance devices 111*b* and fluid resistance devices 111*e* on his waist. A swimmer might combine muscular resistance devices 111*g* and buoyancy devices 111*h* on his legs.

Although a specific embodiment of the present invention has been described and illustrated, the present invention is not limited to the features of this embodiment, but includes all variations and modifications within the scope of the claims.

What is claimed is:

1. An apparatus for providing a force to a portion of a user's body, said apparatus comprising:

a cuff configured to circumscribe the portion of the user's body, said cuff including an attachment structure;

a first resistance device configured as an attachment that is movable into and out of releasable engagement with said attachment structure on said cuff to provide a first resistance force to the portion of the user's body when said cuff and said first resistance device are moved together through the air or water; and a second resistance device configured as an attachment that is movable into and out of releasable engagement with said attachment structure on said cuff as a replacement for said first resistance device, said second resistance device differing from said first resistance device to provide a second, different resistance force to the portion of the user's body when said cuff and said second resistance device are moved together through the air or water;

wherein said attachment structure on said cuff defines a channel, said first resistance device has a first edge portion removably insertable within said channel, and said second resistance device has a second edge portion removably insertable within said channel in place of said first edge portion of said first resistance device; and wherein said channel is ratcheted to engage either of said edge portions of said resistance devices at a plurality of discreet angles.

2. An apparatus as defined in claim 1 wherein said cuff includes an arch having a first leg, a second leg, and said attachment structure, and further includes a retention strap configured to engage said first and second legs of said arch to form an enclosed region for circumscribing the portion of the user's body.

3. An apparatus as defined in claim 2 further comprising an inner sleeve inscribing the region defined by said arch and said retention strap.

4. An apparatus as defined in claim 3 wherein the arch is perforated.

* * * * *